United States Patent [19]

Thornell

[11] 4,321,906

[45] Mar. 30, 1982

[54] TOY PROJECTOR

[76] Inventor: Ernest L. Thornell, 853 W. Sixth St., Booneville, Ark.

[21] Appl. No.: 138,418

[22] Filed: Apr. 8, 1980

[51] Int. Cl.[3] ..... F41B 7/00

[52] U.S. Cl. ..... 124/10; 124/45; 273/324

[58] Field of Search ..... 124/16, 1, 10; 273/129 P, 324; 46/145, 129; 4/189; 221/307, 310; 49/34, 68, 371; 160/DIG. 8, 179; 221/310

[56] References Cited

U.S. PATENT DOCUMENTS

| | | | |
|---|---|---|---|
| 2,648,429 | 8/1953 | Smith | 221/310 X |
| 2,832,406 | 4/1958 | Turenne | 160/179 |
| 4,090,637 | 5/1978 | Williamson | 221/310 X |

*Primary Examiner*—Richard C. Pinkham
*Assistant Examiner*—William R. Browne
*Attorney, Agent, or Firm*—Bacon & Thomas

[57] ABSTRACT

A sheet of resiliently bendable but relatively stiff material has a hole from which slits radiate to define a circular series of stiff but resiliently bendable tabs. When the sheet is pressed downwardly over a fairly hard ball the tabs are flexed to pass over the diameter of the ball and they then snap back to normal position projecting the ball upwardly by cam action on its lower hemisphere. In one form of the invention a flexible magazine is secured to one side of the projector permitting sequential forcing of balls through the projector in rapid fire fashion.

6 Claims, 9 Drawing Figures

TOY PROJECTOR

BACKGROUND OF THE INVENTION

This invention is in the field of projector devices for projecting balls or the like.

Children enjoy projectors for projecting devices into the air and can devise many games to be played thereby. Most projectors known to the applicant however involve the use of springs or the like to effect projection and are of generally complicated construction. There is need for an extremely simple, yet effective and dependable projector for small objects.

SUMMARY OF THE INVENTION the present invention is of extremely simple construction comprising essentially a material having a multiplicity of radiating slots, radiating from a central point. When the sheet is pressed down over an object to be projected, such as a "ping-pong" ball, the tabs between the slots are deflected and the ball will be projected upwardly at a fairly high velocity after the tips of the taps formed by the slots pass over the diameter of the ball.

The toy may take the form of a dish having the slotted sheet defining a portion of the bottom thereof, or may take the form of a simulated animal or the like having a magazine from which the balls may be sequentially forced through the slitted sheet to be projected in sequence.

DESCRIPTION OF THE PREFERRED EMBODIMENTS

Figure 5:
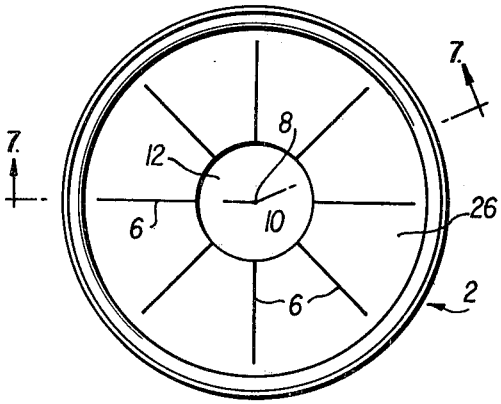
FIG. 5 is a plan view of the basic projector element.

Referring first to FIG. 5, there is shown therein the basic projector element comprising a sheet 2 of suitable plastic material of substantial rigidity, but which is highly resilient. Experience has indicated that the most practical thickness of the sheet is from 0.015 to 0.030 inches. However, a heavier disk could be used to propel a larger and heavier ball than that contemplated in the following description.

Figure 7:
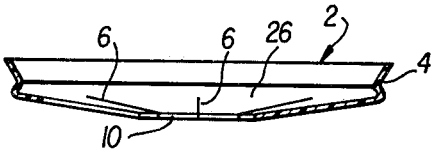
FIG. 7 is a sectional view taken along the line 7-7 of FIG. 5.

As shown in FIG. 7, the disk 2 is of generally concave dish shape and is provided with an inwardly extending groove portion 4 at its outer periphery for a purpose to be described. The sheet 2 could also be flat or convex. The sheet 2 is provided with a multiplicity of radial slits 6, extending generally radially from an imaginary central point at 8. As shown in FIG. 5, each of the tabs are defined by adjacent slits 6 and terminates in an inner edge 10 extending transversely of the radius to define a central opening 12 in the device. That opening is provided as a safety feature, so that a child cannot be harmed by having a finger extended into the device and being locked thereby.

Figure 6:
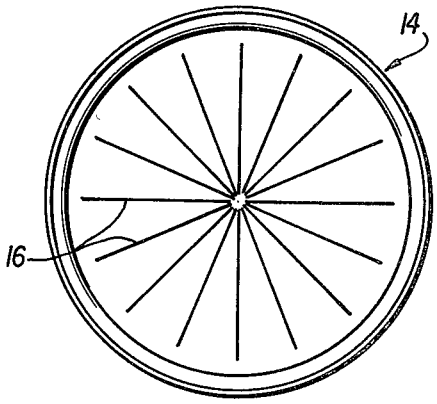
FIG. 6 is a plan view, similar to FIG. 5, but showing a modified but equivalent form.

FIG. 6 shows an alternative form wherein the disk 14 is provided with slits 16 also extending generally radially from a central point, but in this form the tabs between the slits 16 are not provided with the edges 10, as described with reference to FIG. 5. This form, however, presents some danger to a child who may inadvertently get his finger locked in the projector device by projecting his finger into the central portion.

Referring now to FIGS. 1 to 4, the disk element described with reference to FIG. 5 is shown as being mounted in a molded dish-like member 18, having a bottom wall 20 provided with an opening in which the projector element of FIG. 5 is pressed or snap-fitted by engaging the groove 4 over the peripheral edge of the central opening in the dish-like member.

Figure 1:
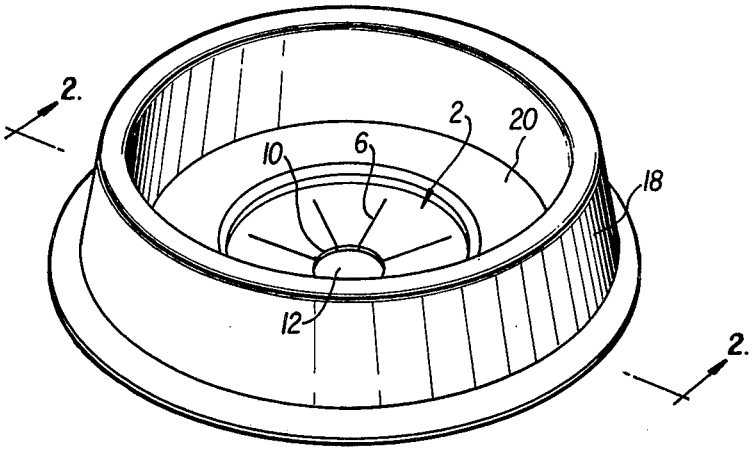
FIG. 1 is a perspective view of one form of the present invention.
Figure 2:
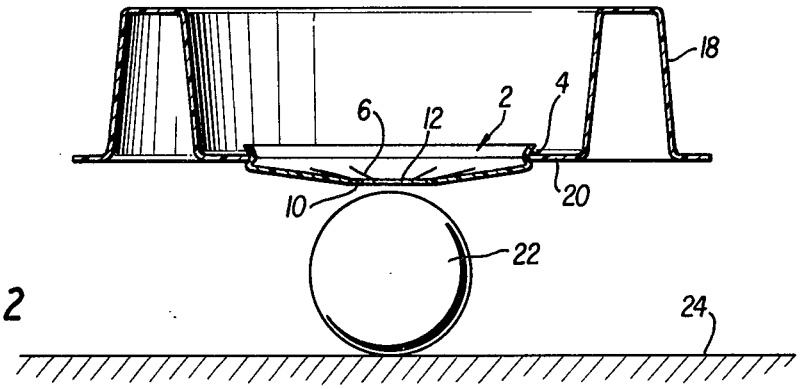
FIGS. 2, 3 and 4 are sectional views taken substantially along the line 2-2 of FIG. 1, showing sequential steps in the operation of the projector.
Figure 3:
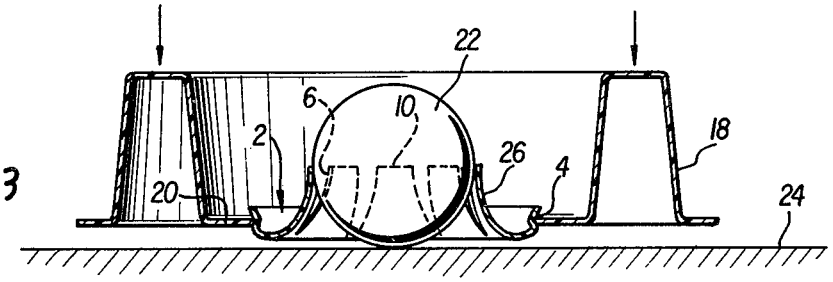
Figure 4:
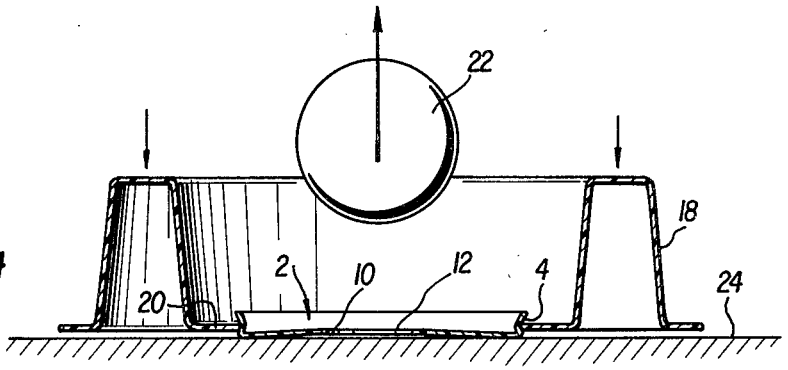

As shown in FIG. 2, a lightweight ball 22, which may be a "ping-pong" ball, may be placed on a surface 24 such as a table top or the like. The projector device is brought downwardly onto the ball and with the ball directly below the central opening 12. Upon then pressing the projector device downwardly, as shown in FIG. 3, the tabs 26, between the slits 6, are flexed upwardly by the ball itself and nothing happens until such time as the ends of the tabs reach at least the horizontal diameter of the ball 22. As shown in FIG. 3, this condition is reached before the projector device reaches the surface 24 and continued downward movement thereof causes the inner ends of the tabs 26 to engage the ball 22 below its horizontal diameter and thus a camming action will permit the tabs 26 to flex back to their normal position and in so doing, they will cam the ball 22 upwardly and project the same into the air as indicated by the arrow in FIG. 4. The dish-shaped member 18 may then be manipulated by the child in attempts to catch the ball while the air or in accordance with any other rules established for the game.

Figure 8:
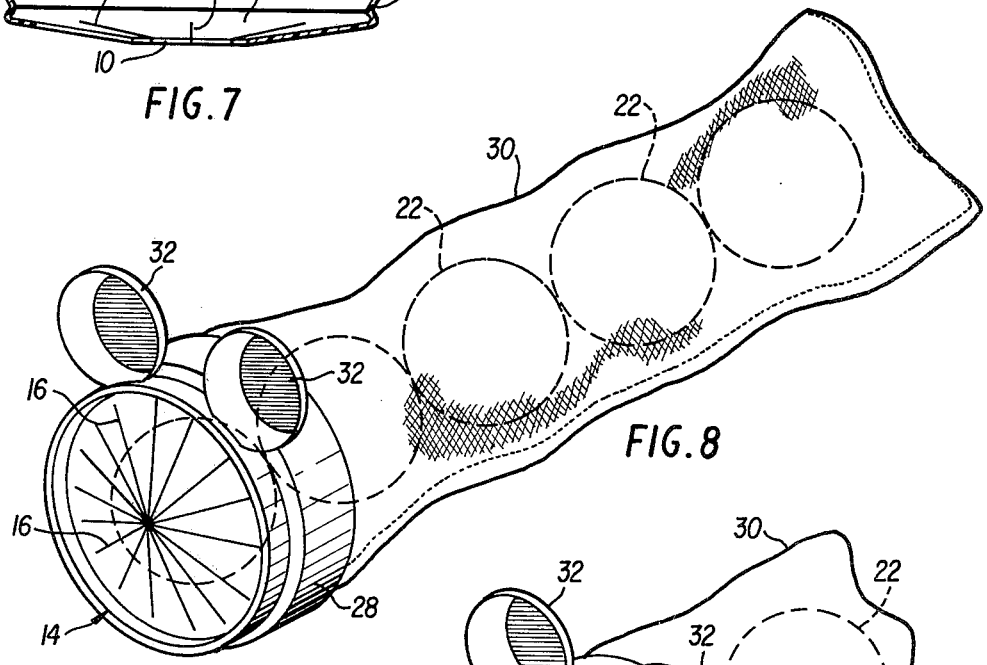
FIG. 8 is a perspective view of a modified form of projector.
Figure 9:
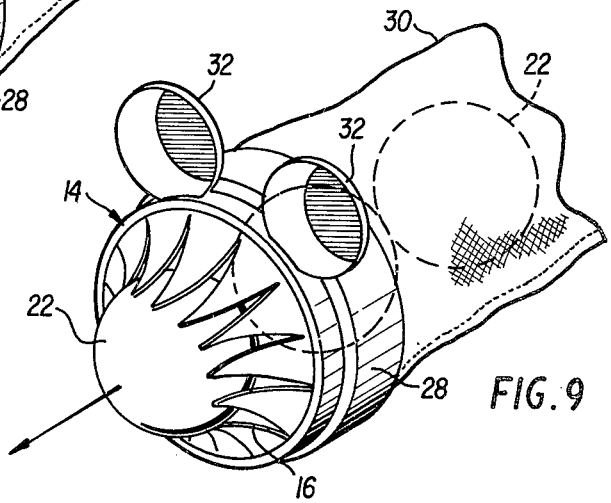
FIG. 9 is a fragmentary view of the device of FIG. 8, showing how a ball is projected thereby.

Referring now to FIGS. 8 and 9, the slitted disk of FIG. 6 is shown as being attached to an end ring 28 defining the mouth of an elongated flexible bag 30 which is closed at its rear end. The bag 30 thus becomes a flexible magazine adapted to contain a single row of a plurality of the balls 22. To load the magazine, it is only necessary to push the balls inwardly through the sheet 14, until they pass the center diameter and are retained therein. A child by then pushing forwardly on the row of balls 22 can force the leading ball through the sheet 14 to flex the same as indicated in FIG. 9, whereupon the balls will be projected forwardly at a relatively high velocity. Obviously the balls may be forced forwardly through the projector in rapid fire manner, thus adding to the attractiveness of the game.

As shown in FIGS. 8 and 9, the device is provided with simulated eyes 32 to imitate a dragon or other animal.

While the projectiles have been described as balls, obviously other articles, having a suitably tapering portion could be employed. The lower hemisphere of the ball shown is essentially a downwardly tapering body.

While a limited number of forms of the invention have been shown and described, the same are merely illustrative of the principles involved, and other forms may be employed within the scope of the appended claims.

I claim:

1. In combination an article projecting device and a generally spherical article to be projected, said combination including: a generally spherical article to be projected, said article having tapering portions, a manually movable device including a sheet of resiliently bendable relatively stiff material having a multiplicity of slits therethrough, all of said slits converging generally toward a common point and defining a multiplicity of resilient tabs;

said slits being of sufficient length to permit said tabs to be flexed upwardly of said sheet, within their elastic limits, to permit said article of predetermined diameter to pass through said sheet and for the inner ends of said tabs to engage said tapering portions of said article whereupon resilient recovery of said tabs cams said tapering portions of said article and thereby project said article away from said projector.

2. A projector as defined in claim 1 wherein said article is a spherical ball, said slits extending from said common point a distance greater than the radius of said ball.

3. A projector as defined in claim 1 wherein each of said tabs has a transverse edge at its inner end spaced from said common point whereby said edges define a central opening in said sheet.

4. A projector as defined in claim 1 wherein said sheet comprises at least a central portion of the bottom of an upwardly open cup-shaped member.

5. A projector as defined in claim 1 including a magazine secured to and extending from one face of said sheet, said magazine supporting a plurality of said articles in generally axial alignment with said common point whereby said articles may be sequentially forced through said sheet to be projected thereby.

6. A projector as defined in claim 1 wherein said article is a spherical ball of relatively hard material;

each of said tabs having a transverse inner end edge spaced from said common point whereby said edges define a central opening in said sheet; and the length of said slits being so related to the diameter of said ball that when the ball is placed on a supporting surface and the sheet forced downwardly thereover the tabs will be flexed sufficiently to permit the ball to pass through said sheet and to cause said end edges of said tabs to engage the lower hemisphere of said ball.

* * * * *